US008061328B2

(12) United States Patent
Shafer et al.

(10) Patent No.: US 8,061,328 B2
(45) Date of Patent: Nov. 22, 2011

(54) HIGH PRESSURE PUMP AND METHOD OF REDUCING FLUID MIXING WITHIN SAME

(75) Inventors: Scott F. Shafer, Morton, IL (US); Alan R. Stockner, Metamora, IL (US); Greg W. Hefler, Chillicothe, IL (US); Chris L. Stewart, Dunlap, IL (US); Dan Rushton, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 777 days.

(21) Appl. No.: 11/076,384

(22) Filed: Mar. 9, 2005

(65) Prior Publication Data

US 2006/0201484 A1 Sep. 14, 2006

(51) Int. Cl.
*F01M 1/02* (2006.01)
*F02M 57/02* (2006.01)

(52) U.S. Cl. ..... 123/446; 123/196 R

(58) Field of Classification Search ..... 123/456, 123/458, 446, 495, 457, 196 R; 417/65, 417/205, 306; 184/6.28, 26
See application file for complete search history.

(56) References Cited

U.S. PATENT DOCUMENTS

| | | | | |
|---|---|---|---|---|
| 2,136,466 | A * | 11/1938 | Ritz | 123/446 |
| 4,478,423 | A | 10/1984 | Hjelsand et al. | |
| 4,480,623 | A | 11/1984 | Thomas | |
| 4,573,444 | A * | 3/1986 | Howes | 123/502 |
| 4,576,133 | A * | 3/1986 | Silcock et al. | 123/458 |
| 4,590,910 | A * | 5/1986 | Lintott et al. | 123/458 |
| 5,897,119 | A | 4/1999 | McMillen | |
| 5,901,686 | A | 5/1999 | Stockner et al. | |
| 5,979,415 | A | 11/1999 | Sparks et al. | |
| 5,983,863 | A | 11/1999 | Cavanagh et al. | |
| 5,992,768 | A | 11/1999 | Beatty et al. | |
| 6,634,459 | B1 * | 10/2003 | Litkenhus et al. | 184/6.12 |
| 6,805,105 | B2 * | 10/2004 | Kato et al. | 123/514 |
| 7,152,583 | B2 | 12/2006 | Abe et al. | |
| 7,234,448 | B2 | 6/2007 | Hanyu | |
| 2002/0096145 | A1 * | 7/2002 | Ricco et al. | 123/446 |
| 2003/0108443 | A1 | 6/2003 | Suzuki et al. | |
| 2003/0219346 | A1 | 11/2003 | Abe et al. | |
| 2004/0021003 | A1 | 2/2004 | Hefler et al. | |
| 2005/0047929 | A1 | 3/2005 | Hanyu | |
| 2006/0201484 | A1 | 9/2006 | Shafer et al. | |
| 2009/0114189 | A1 * | 5/2009 | Shafer et al. | 123/446 |

FOREIGN PATENT DOCUMENTS

| | | |
|---|---|---|
| AT | 307808 | 6/1973 |
| GB | 2237074 A | 4/1991 |
| GB | 2248657 A | 4/1992 |
| GB | 2305221 A | 4/1997 |
| WO | WO 2005/017360 | 2/2005 |

* cited by examiner

*Primary Examiner* — Hai H Huynh
(74) *Attorney, Agent, or Firm* — Miller, Matthias & Hull

(57) ABSTRACT

Mixing of lubrication fluid and pumped fluid within a pump can undermine lubricity of the lubrication fluid and/or contaminate the pumped fluid (e.g. fuel) with lubrication fluid. In order to reduce mixing of fluids within a high pressure pump of the present disclosure, a lubrication fluid is supplied to the high pressure pump. A low pressure pump supplies a second fluid to the high pressure pump. The pressure of the second fluid is increased within at least one piston bore of the high pressure pump. Mixing of the lubrication fluid and the second fluid is reduced by fluidly connecting a weep annulus which is opened to the at least one piston bore to a low pressure pump inlet of the low pressure pump.

3 Claims, 3 Drawing Sheets

HIGH PRESSURE PUMP AND METHOD OF REDUCING FLUID MIXING WITHIN SAME

TECHNICAL FIELD

The present disclosure relates generally to high pressure pumps, and more specifically to reducing fluid mixing within a high pressure pump.

BACKGROUND

Lubrication fluid, such as oil, is generally pumped through a fluid pump in order to lubricate the moving parts of the pump. Mixing of the lubrication fluid with the fluid being pumped can undermine the lubricity of the lubrication fluid and/or contaminate the fluid being pumped with the lubrication fluid. For example, many fuel systems include a low pressure transfer pump that draws fuel from a fuel tank and a high pressure pump that increases the pressure of the fuel before injection. Lubrication fluid, generally oil, flows within the high pressure pump to lubricate the moving parts. Cam-driven, reciprocating pistons within piston bores of the high pressure pump increase the pressure of the fuel. The reciprocating motion of the piston and the pressure within the piston bore can cause some of the fuel to migrate between the piston and the piston bore. If the fuel is permitted to migrate outside of the piston bore and into a cam-housing region, the fuel will directly mix with oil, decreasing the lubrication quality of the lubrication oil, which can lead to potentially serious problems throughout the lubrication system.

In order to reduce the fuel migration between the reciprocating piston and the piston bore, it is known to position a seal, such as an o-ring, between the piston bore and the reciprocating piston. The seal blocks the migration of the fuel into the lubrication oil system. However, many fluid pumping reciprocating pistons can be subjected to relatively extreme pressure changes, thereby reducing the life and the sealing capability of the seals.

In order to relieve the pressure on a seal, being an o-ring, and further reduce fluid mixing, a fluid seal, described in U.S. Pat. No. 5,901,686, issued to Stockner et al. on May 11, 1999, is designed for a fuel injector that includes a reciprocating piston within a piston bore including a pressurization chamber in which fuel pressure is increased. The fluid seal includes an annular pressure accumulation volume defined by the piston and positioned between the pressurization chamber and the o-ring. A fuel injector body defines a pressure release passage positioned between the accumulation volume and the pressurization chamber and that fluidly connects the piston bore to a low pressure return line.

As fuel migrates between the piston bore and the piston when the piston advances to pressurize the fuel within the pressurization chamber, pressure on the o-ring is reduced by some of the fuel flowing from the bore to the pressure release passage while another portion of the fuel accumulates within the pressure accumulation volume. When the pressure accumulation volume of the advancing piston is aligned with the pressure release passage, the pressure on the o-ring dramatically drops being that the pressure accumulation volume drops to the same low pressure as the low pressure return line. The pressure with the accumulation volume will again build when the piston advances past the pressure release passage until the injection event ends.

Although the pressure on the o-ring is reduced by the combination of the pressure accumulation volume and the pressure release passage, the fuel migrating up the piston bore is still permitted to migrate and accumulate within the piston bore for the majority of the pressure stroke of the piston. Only for the brief time that the pressure accumulation volume is fluidly connected to the pressure release passage is the fuel within the pressure accumulation volume able to evacuate from piston bore.

The present disclosure is directed at overcoming one or more of the problems set forth above.

SUMMARY OF THE INVENTION

In one aspect of the present disclosure, a fuel system includes a low pressure pump that includes a low pressure pump housing defining a low pressure pump inlet and a low pressure pump outlet. The low pressure inlet is fluidly connected to a source of fuel, and the low pressure pump outlet is fluidly connected to a high pressure pump inlet defined by a housing of a high pressure pump. The high pressure pump housing also defines a high pressure pump outlet, at least one piston bore and a weep annulus, which opens to the at least one piston bore. The weep annulus is fluidly connected to the low pressure pump inlet.

In another aspect of the present disclosure, a compound pump assembly includes a low pressure pump that includes a low pressure pump housing to which a high pressure pump housing of a high pressure pump is attached. The low pressure pump housing defines a low pressure pump inlet and a low pressure pump outlet. The high pressure housing defines a high pressure pump inlet, high pressure pump outlet, at least one piston bore, and a weep annulus which opens to the at least one piston bore. The low pressure pump outlet is fluidly connected to the high pressure pump inlet, and a drain line fluidly connects the weep annulus to the low pressure pump inlet.

In yet another aspect of the present disclosure, there is a method of reducing fluid mixing. A lubricating fluid is supplied to a high pressure pump. A second fluid is pumped from a source of fluid to the high pressure pump via a low pressure pump. The pressure of the second fluid is increased within at least one piston bore of the high pressure pump. Mixing of the second fluid and the lubricating fluid is reduced, at least in part, by fluidly connecting a weep annulus, which opens to the at least one piston bore, with a low pressure pump inlet of the low pressure pump.

DETAILED DESCRIPTION

Figure 1:
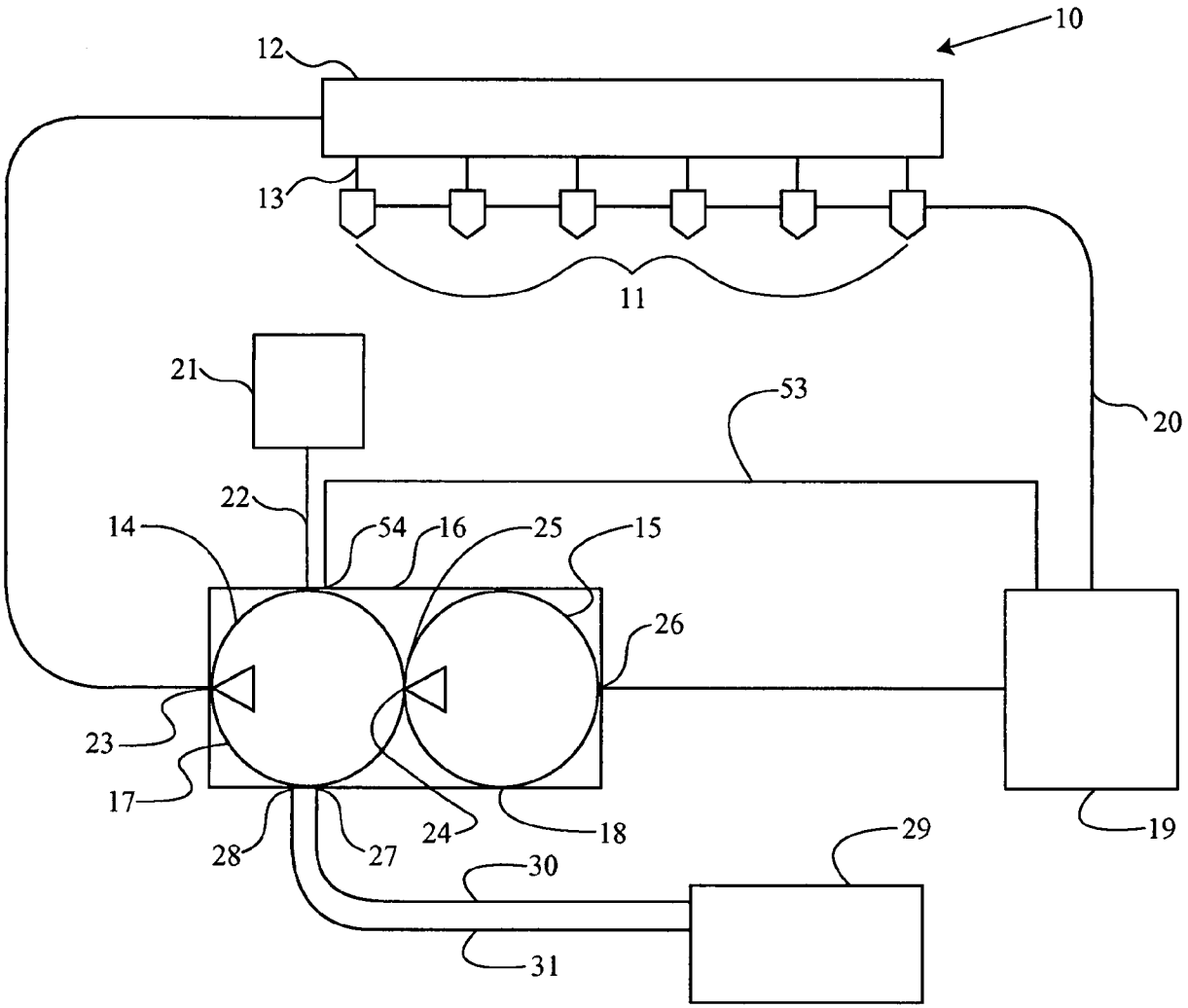
FIG. 1 is a schematic illustration of a fuel system, according to the present disclosure.

Referring to FIG. 1, there is shown a schematic illustration of a fuel system 10, according to the present disclosure. The fuel system 10 includes a plurality of fuel injectors 11, which are each connected to a high pressure fuel rail 12 via individual branch passages 13. The high pressure fuel rail 12 is supplied with high pressure fuel from a high pressure pump 14 that is supplied with relatively low pressure fuel by a low pressure pump 15. A high pressure pump housing 17 of the high pressure pump 14 defines a high pressure pump outlet 23 fluidly connected to the fuel common rail 12 and a return line outlet 54 fluidly connected to the fuel tank 19 via a first return line 53. A low pressure pump housing 18 of the low pressure pump 15 defines a low pressure pump inlet 26 fluidly connected to the fuel tank 19, which is also fluidly connected to the fuel injectors 11 via a second return line 20. Although the present disclosure contemplates the high pressure pump 14 and the low pressure pump 15 being separate from one another in separate housings, in the illustrated embodiment, the low pressure pump 15 and the high pressure pump 14 may be both included within a compound pump assembly 16. The high pressure pump housing 17 of the high pressure pump 14 is attached to the low pressure pump housing 18 of the low pressure pump 15 in a conventional manner, such as bolts. The low pressure pump housing 18 defines a low pressure pump outlet 25 that is fluidly connected to a high pressure pump inlet 24 defined by the high pressure pump housing 17. The high pressure pump housing 17 also defines a lubrication fluid inlet 27 and a lubrication fluid outlet 28. The lubrication fluid inlet 27 and the lubrication fluid outlet 28 are fluidly connected to a source of lubrication fluid 29, illustrated as an engine oil sump, via as a lubrication supply line 30 and a lubrication drain line 31, respectively.

The fuel system 10 is controlled in its operation in a conventional manner via an electronic control module 21 which is connected to the high pressure pump 14 via a pump communication line 22 and connected to each fuel injector 11 via communication lines (not shown). When in operation, control signals generated by the electronic control module 21 determine when and how much fuel displaced by the high pressure pump 14 is forced into the common rail 12, as well as when and for what duration (fuel injection quantity) that fuel injectors 11 operate. The fuel not delivered to the fuel common rail 12 can be re-circulated back to the fuel tank 19 via the first return line 53.

Figure 2:
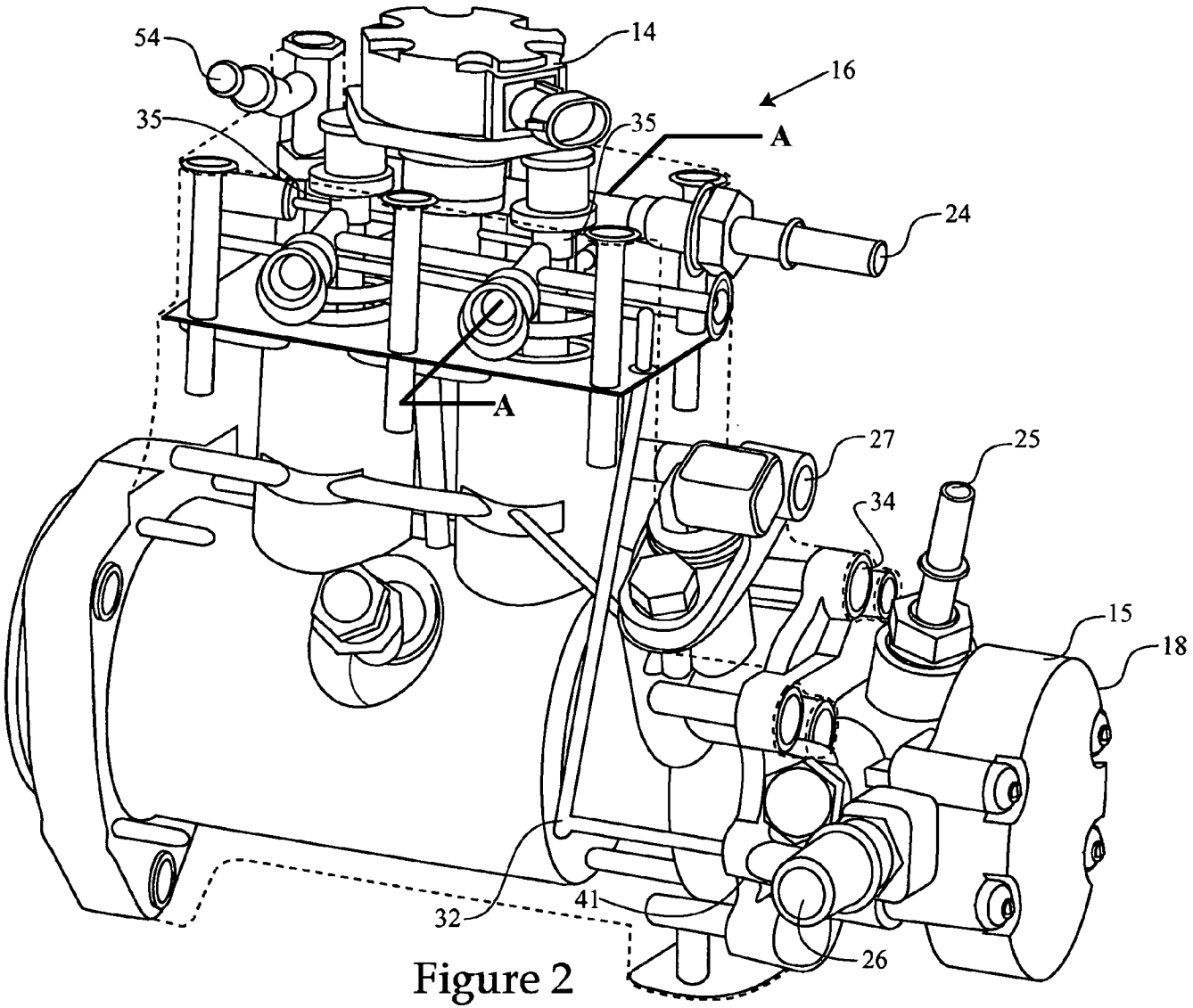
FIG. 2 is an isometric view of a compound pump assembly within the fuel system of FIG. 1.

Referring to FIG. 2, there is shown an isometric view of the compound pump assembly 16 within the fuel system 10 of FIG. 1. It should be appreciated that a portion of the high pressure pump housing 17 and a fluid communication line connecting the low pressure pump outlet 25 with the high pressure pump inlet 24 have been removed from the compound pump assembly 16 in order to illustrate an internal structure of the high pressure pump 14. A perimeter of the high pressure pump housing 17 is illustrated by a dotted line. The low pressure pump housing 15 defines a plurality of bolt bores 34 through which the high pressure pump housing 17 can be bolted to the low pressure pump housing 18. The high pressure pump housing 17 includes two barrels 35, each defining, in part, a piston bore 33 (shown in FIG. 3). A drain line 32 fluidly connects two weep annuluses 40 (shown in FIG. 3), each opening to a respective piston bore 33, to the low pressure pump inlet 26 of the low pressure pump 15. Although the illustrated embodiment includes two piston bores, it should be appreciated that the pump 14 could include any number of piston bores, each opened to a weep annulus. The drain line 32 is attached to the low pressure pump inlet 26 via a conventional T-connection 41. Thus, the drain line 32 fluidly connects the piston bore 33 which is generally at a relatively high pressure to low pressure fuel flowing into the low pressure pump 15, thereby creating a pressure differential. Those skilled in the art will appreciate that the greater the velocity of the fuel flow, the lower the pressure within the low pressure pump inlet 26. The lubrication fluid inlet 27 and outlet (not shown) allow oil to flow into and out of the high pressure pump housing 17 and lubricate the moving parts.

Figure 3:
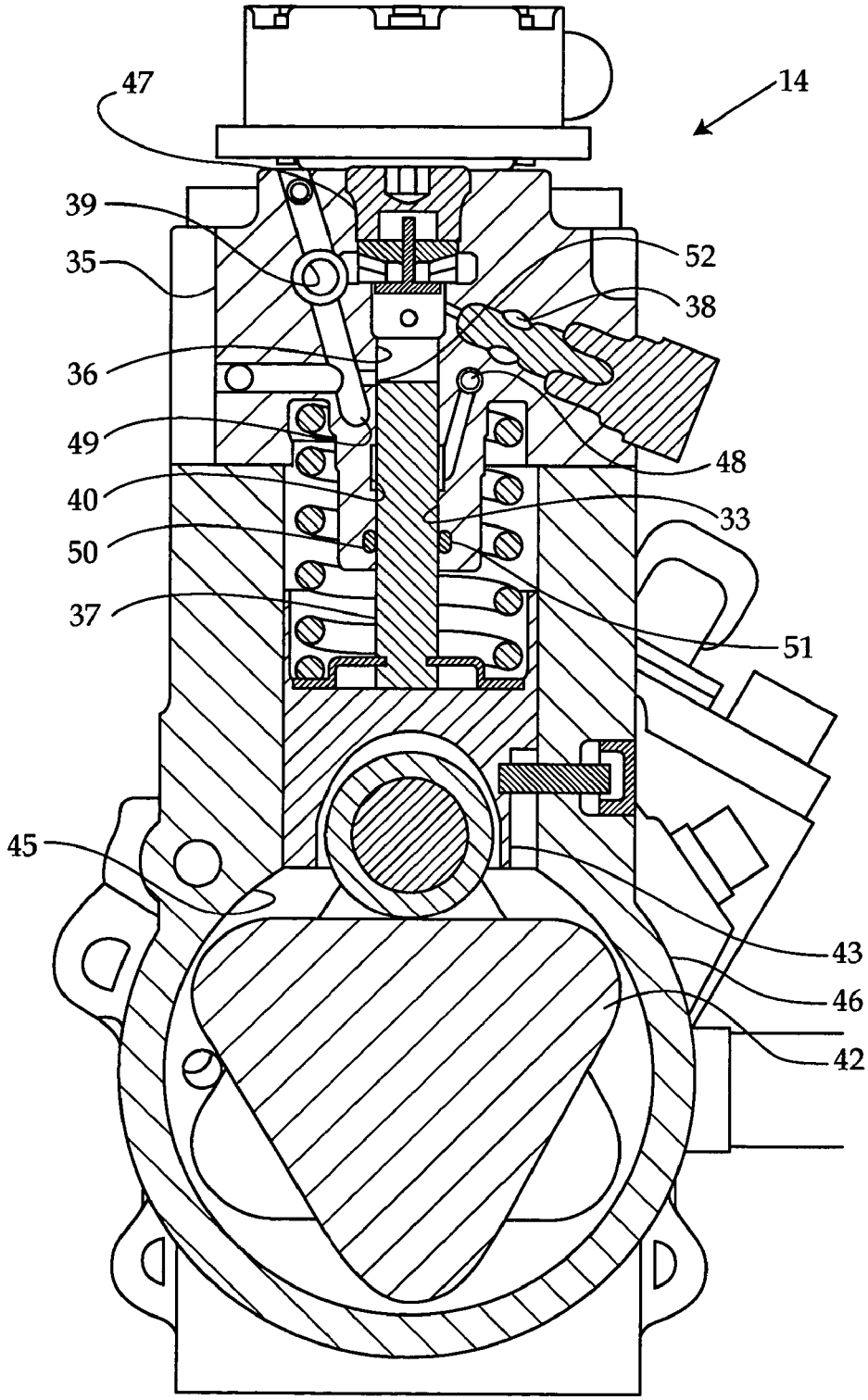
FIG. 3 is a side sectioned view along line AA of a high pressure pump of the compound pump assembly of FIG. 2.

Referring to FIG. 3, there is shown a side sectioned view of the high pressure pump 14 of the compound pump assembly 16 of FIG. 2. The barrel 35 that is part of the pump housing 17 defines the piston bore 33 in which a piston 37 reciprocates. Although only one piston 37 within one piston bore 33 is illustrated, it should be appreciated that both pistons within the piston bores operate similarly. The piston 37 and the piston bore 33 define a pumping chamber 36 that is fluidly connectable to a high pressure gallery 38 and a low pressure fuel supply gallery 39. The high pressure gallery 38 is fluidly connected to the high pressure pump outlet 23, and the low pressure fuel supply gallery 39 is fluidly connected to the high pressure pump inlet 24. The piston 37 is coupled to rotate with a cam 42 via a tappet 43 in a conventional manner. The cam 42 rotates and the tappet 43 reciprocates within a cam region 45 defined by a cam housing 46. Although not shown, a second piston reciprocates with a second cam. The pair of cams are operable to cause the pistons to reciprocate out of phase with one another. The cams are preferably driven to rotate directly by the engine at a rate that preferably synchronizes pumping activity to fuel injection activity in a conventional manner. It should be appreciated that the movement of the cams, including cam 42, and tappet 43 are lubricated by the flow of lubrication fluid. Thus, there is oil flowing within the cam region 45.

When the piston 37 is undergoing its retracting stroke, fresh low pressure fuel is drawn from the low pressure fuel supply gallery 39 past an inlet check valve and into the pumping chamber 36. When in the retracting stroke, fluid communication between the pumping chamber 36 and the low pressure fuel supply gallery 39 via a spill control valve 47 is blocked. When the piston 37 is undergoing its pumping stroke, the pressure within the pumping chamber 36 moves a shuttle valve member of the spill control valve 47 in order to fluidly connect the pumping chamber 36 to the low pressure fuel supply gallery 39 via the spill control valve 47. The fuel may be displaced from the pumping chamber 36 into the low pressure gallery 39 via the spill control valve 47. The spill control valve 47 includes an electrical actuator that can be activated to close the spill control valve 47 during the pumping stroke in order to control the output from the pumping chamber 36. When the spill control valve 47 is closed, the fuel in the pumping chamber 36 will be pushed past the check valve into the high pressure gallery 38 and into the high pressure common rail 12. Those skilled in the art will appreciate that the timing at which the electrical actuator is energized determines what fraction of the amount of fuel displaced by the piston action is pushed into the high pressure gallery 38 and what other fraction is displaced back to the low pressure gallery 39. Because the pistons are reciprocating out of phase with one another and the pumping chamber 36 is only connected to the low pressure fuel supply gallery 39 via the spill control valve 47 during the pumping stroke, the pumping chambers 36 can share one spill control valve 47. It should be appreciated that the present disclosure contemplates use with various high pressure pumps, including pumps that vary pump output in a different manner than illustrated and pumps that do not have any variable discharge capabilities.

The weep annulus 40 opens to the piston bore 33 and is fluidly connected to the drain line 32 via a drain gallery 48 defined by the high pressure pump housing 17. The barrel 35 preferably defines a seal groove 50 in which seal 51 may be positioned. Seal 51 may be an o-ring, a glyd ring or an equivalent known in the art. The seal groove 50 is positioned along the piston bore 33 between the weep annulus 40 and the cam region 45. As the piston 37 reciprocates, fuel that migrates between the piston 37 and the piston bore 33 can be drawn into the weep annulus 40 and the drain gallery 48. Because the piston bore 33 is at a higher pressure than the low pressure pump inlet 26, the migrating fuel is drawn to the low pressure inlet 26 before reaching the cam region 45 in which the oil is being circulated. Any fuel not drawn into the weep annulus 40 can be sealed from the cam region 45 via the seal 51.

The high pressure pump housing 17 also defines a debris basin 49 fluidly connected to the low pressure fuel supply gallery 39. The debris basin 49 is a cavity defined by the barrel 35 extending below the bottom fill port 52 connected to the pumping chamber 36. Thus, gravity can pull debris that is heavier than the fuel entering the bottom fill port 52, into the debris basin 49 rather than enter the pumping chamber 36. Preferably, the present disclosure includes a debris basin for each piston bore.

INDUSTRIAL APPLICABILITY

Referring to FIGS. 1-3, a method of reducing fluid mixing with the high pressure pump 14 of the compound pump assembly 16 will be discussed. Although the operation of the present disclosure will be discussed for the fuel system 10, it should be appreciated that present disclosure can work similarly for any fluid system including a low pressure fluid pump and a high pressure fluid pump. Moreover, the low pressure pump and the high pressure pump need not be part of a compound pump as illustrated. Further, although the present disclosure will be discussed for one piston bore 33, it should be appreciated that the present disclosure operates similarly for both piston bores.

Lubrication fluid, illustrated in the present disclosure as oil, is supplied to the high pressure pump 15 from the source of lubrication fluid 29 via the lubrication fluid supply line 30. The oil is generally drawn from the source 29 via a pump (not shown) and circulated through the cavities of the high pressure pump 14, including the cam region 45 defined by the cam housing 46. The oil will lubricate the moving cam 42 and the tappet 43. It is improbable, but possible, for limited amount of oil to migrate past the seal 51 in between the piston 37 and the piston bore 33. The oil can return to the lubrication fluid source 29 via the lubrication return line 31.

A second fluid, being fuel, is pumped from the fuel tank 19 to the high pressure pump 14 via the low pressure pump 15. It should be appreciated that although the high pressure pump housing 17 is attached to the low pressure pump housing 18, the present disclosure contemplates the two pumps being separated and detached from one another. The fuel will flow from the low pressure pump outlet 25 to the high pressure pump inlet 24 and into the low pressure fuel supply gallery 39 of the high pressure pump 14 until drawn into the pumping chamber 36 for pressurization.

The pressure of the fuel is increased within the pumping chamber 36 within the piston bore 33 of the high pressure pump 14. Although the present disclosure is discussed only for one piston 37 within piston bore 33, it should be appreciated that second piston operates similarly to the piston 37 except that the pistons reciprocate out of phase with one another. Moreover, it should be appreciated that the present disclosure could be used with a pump having any number of piston bores, including only one. As piston 37 undergoes its retracting stroke, fuel will be drawn into the pumping chamber 36 via the low pressure fuel supply gallery 39. Because the spill control valve 47 does not fluidly connect the low pressure fuel supply gallery 39 with the pumping chamber 36 while the piston 37 is retracting, the fuel will flow into the pumping chamber 36 via the inlet check valve and bottom fill port 52. Positioned below the bottom fill port 52 and fluidly connected to the low pressure fuel supply gallery 39 is the debris basin 49. The debris basin 49 is a cavity that can collect debris from the fuel within the low pressure fuel supply gallery 39 before flowing into the bottom fill port 52. Due to gravity, the debris will separate from the fuel and collect in the debris basin 49 while the fuel is drawn into the pumping chamber 36 via the bottom fill port 52. Because the debris is separated from the fuel, the debris cannot interfere with the motion of the piston 37 and cause pump seizure.

As the piston 37 undergoes its pumping stroke, the pumping chamber 36 will be fluidly connected to the low pressure fuel supply gallery 39 via the spill control valve 47. The advancing piston 37 will push the fuel into the low pressure supply gallery 39. When there is a desire to output high pressure fuel from the pump 14, the electrical actuator of the spill valve 47 is activated, thereby blocking the flow of fuel to the low pressure supply gallery 39 and forcing the pressurized fuel to flow past the check valve and into the high pressure gallery 38. As the piston 37 advances, the increased pressure within the pumping chamber 36 can cause some of the fuel to migrate between the piston 37 and the sides of the piston bore 33. The retracting action of the piston 37 can also drag some of the fuel between the piston 37 and the piston bore 33. Although the present disclosure includes the spill control valve 47 to control the fuel output from the pump 14, it should be appreciated that the present disclosure contemplates use with pumps without spill control valves and/or without variable discharge capabilities.

The mixing of the fuel with the oil is reduced, at least in part, by fluidly connecting the weep annulus 40 to the low pressure inlet 26 of the low pressure pump 15. As the fuel migrates down the piston bore 33 and the piston 37, the fuel will reach the weep annulus 40. The pressure differential between the piston bore 37 and the low pressure fuel flowing into the low pressure pump inlet 26 will draw the fluid from the weep annulus 40 to the low pressure pump inlet 26 via the drain gallery 48 and drain line 32. Because the drain line 32 is fluidly connected to the low pressure inlet 26 via the T-connection 41, the drain line 32 is fluidly connected to the flow of the low pressure fuel from the fuel tank 29 to the low pressure pump 15. Thus, the T-connection 41 may further increase the pressure differential that causes evacuation of the weep annulus 40. If any fuel is not evacuated through the weep annulus 40, but rather continues to migrate down the piston bore 33, the seal 51 can seal the fuel within the piston bore 33 from the oil within the cam region 45. Similarly, the seal 51 can seal oil being draw into the piston bore 33 via the reciprocating action of the piston 37 from mixing with the fuel. If some oil does migrate past the seal 51, the oil will be drawn into the weep annulus 40 and circulated back through the pumps 14 and 15, forwarded to the fuel injectors 11 and burned with other fuel. Those skilled in the art will appreciate that fuel within the lubrication fluid system is much less desirable than a small amount of oil within the fuel system 10. Fuel within the oil can undermine lubricity and cause damage to the moving parts intended to be lubricated.

The present disclosure is advantageous because it reduces the risk of fluid mixing due to fuel to oil migration and debris within the piston bore 33. In order to reduce the mixing of the fuel and the oil, the present disclosure utilizes the pressure differential between the low pressure fluid flowing into the low pressure pump inlet 26 and the pressure within the weep annulus 40 to continuously draw the fuel from the weep annulus 40. Because the pressure within the piston bore 33 generally remains at a higher pressure than the pressure of the low pressure pump inlet 26, the fuel and oil migrating to the weep annulus 40 will be continuously evacuated through the drain line 32 rather than migrating down the piston bore 33 and into the oil within the cam region 45. The T-connection 41 between the drain line 32 and low pressure pump inlet 26 may further increase the pressure differential, and thus, the suction drawing the fuel away from the piston bore 33. In addition, the seal 51 is added protection against fuel to oil mixing by sealing the piston bore 33 from the cam region 45 and vice versa. Because the mixing of fuel and oil is reduced, the pump 14 and other engine components can be sufficiently lubricated by the oil, leading to a longer life and more efficient operation.

The present disclosure is also advantageous because the high pressure pump 14 is more debris-resistant, meaning the likelihood that debris within the fuel will enter the pumping chamber 36 is reduced. Gravity can be utilized to separate the debris from the fuel before flowing into the pumping chamber 36. The weight of the debris will cause the debris to collect in the debris basin 49 while the fuel flows into the pumping chamber 36 via the bottom fuel port 52. Because the debris is separated before entering the pumping chamber 36, the risk of the debris interfering with the reciprocating action of the piston 37 is reduced, thereby increasing the ability of the pump 14 to function properly.

It should be understood that the above description is intended for illustrative purposes only, and is not intended to limit the scope of the present invention in any way. Thus, those skilled in the art will appreciate that other aspects, objects, and advantages of the invention can be obtained from a study of the drawings, the disclosure and the appended claims.

What is claimed is:

1. A fuel system comprising:
a source of fuel;
a source of lubrication fluid;
a low pressure pump including:
a low pressure pump inlet fluidly communicating with the source of fuel to define a fuel source flow path between the low pressure pump inlet and the source of fuel; and
a low pressure pump outlet;
a high pressure pump including:
a high pressure pump housing;
a high pressure pump inlet formed in the high pressure pump housing and fluidly communicating with the low pressure pump outlet;
a high pressure pump outlet formed in the high pressure pump housing;
an internal bore formed in the high pressure pump housing and defining a pumping chamber fluidly communicating with the high pressure pump inlet and the high pressure pump outlet;
a piston having a first end disposed in the internal bore and an opposite second end;
a weep annulus formed in the high pressure pump housing and opening toward the internal bore;
a seal disposed between the internal bore and the piston, the seal being located between the weep annulus and the piston second end;
a cam operatively coupled to the piston second end;
a cam housing enclosing the cam;
a lubrication inlet fluidly communicating between the source of lubrication fluid and the cam housing; and
a lubrication fluid outlet fluidly communicating between the cam housing and the source of lubrication fluid;
a drain line fluidly connecting the weep annulus to the fuel source flow path and defining a fuel drain flow path;
a T-connection coupled to the low pressure pump inlet, the T-connection defining a portion of the fuel source flow path and a portion of the fuel drain flow path so that the fuel drain flow path intersects the fuel source flow path at a substantially perpendicular angle;
a common rail fluidly connected to the high pressure pump outlet;
a plurality of fuel injectors fluidly connected to the common rail via individual branch passages; and
an electronic controller in control communication with each of the plurality of fuel injectors and the high pressure pump, and wherein the electronic controller communicating a fuel injection timing and quantity control signal to each of the plurality of fuel injectors and a pump output control signal to the high pressure pump.

2. The fuel system of claim 1 wherein the high pressure pump housing includes a debris basin disposed therein; and
the debris basin being a cavity defined by a barrel and extending below a bottom fill port of a pumping chamber of the high pressure pump so that gravity can pull debris into the debris basin before the debris can enter the bottom fill port.

3. A compound pump assembly comprising:
a source of fuel;
a source of lubrication fluid;
a low pressure pump including:
a low pressure pump inlet fluidly communicating with the source of fuel to define a fuel source flow path between the low pressure pump inlet and the source of fuel; and
a low pressure pump outlet;
a high pressure pump including:
a high pressure pump housing attached to the low pressure pump housing;
a high pressure pump inlet formed in the high pressure pump housing and fluidly communicating with the low pressure pump outlet;
a high pressure pump outlet formed in the high pressure pump housing;
an internal bore formed in the high pressure pump housing and defining a pumping chamber fluidly communicating with the high pressure pump inlet and the high pressure pump outlet;
a piston having a first end disposed in the internal bore and an opposite second end;
a weep annulus formed in the high pressure pump housing and opening toward the at internal bore;
a seal disposed between the internal bore and the piston, the seal being located between the weep annulus and the piston second end;
a cam operatively coupled to the piston second end;
a cam housing enclosing the cam;
a lubrication inlet fluidly communicating between the source of lubrication fluid and the cam housing; and
a lubrication fluid outlet fluidly communicating between the cam housing and the source of lubrication fluid;
a drain line fluidly connecting the weep annulus to the fuel source flow path and defining a fuel drain flow path; and
a T-connection coupled to the low pressure pump inlet, the T-connection defining a portion of the fuel source flow path and a portion of the fuel drain flow path so that the fuel drain flow path intersects the fuel source flow path at a substantially perpendicular angle.

* * * * *